United States Patent [19]

MacIntosh

[11] 4,248,724

[45] Feb. 3, 1981

[54] GLYCOL ETHER/SILOXANE POLYMER PENETRATING AND LUBRICATING COMPOSITION

[76] Inventor: Douglas H. MacIntosh, P.O. Box 1512, Sedona, Ariz. 86336

[21] Appl. No.: 83,073

[22] Filed: Oct. 9, 1979

[51] Int. Cl.[3] ..... C10M 3/14; C10M 3/44

[52] U.S. Cl. ..... 252/49.6; 252/28; 252/52 A; 252/52 R; 252/396; 252/387

[58] Field of Search ..... 252/49.6, 28, 11, 396, 252/52 A, 52 R

[56] References Cited

U.S. PATENT DOCUMENTS

| | | | |
|---|---|---|---|
| 3,532,624 | 10/1970 | Cekada, Jr. | 252/49.6 |
| 3,770,633 | 11/1973 | Holley | 252/49.6 |
| 4,088,591 | 5/1978 | Brown, Jr. et al. | 252/49.6 |

*Primary Examiner*—Jacqueline V. Howard

*Attorney, Agent, or Firm*—Krass & Young

[57] ABSTRACT

A penetrating and lubricating composition consisting of a silicone lubricant dissolved in a glycol ether carrier having a very low surface tension. The glycol ether gives the composition the ability to penetrate into the cracks between two seized or corroded elements and dissolve any rust or corrosion present. The glycol ether then volitalizes leaving a coating of silicone on the parts to serve as a lubricant and prevent further corrosion.

4 Claims, No Drawings

GLYCOL ETHER/SILOXANE POLYMER PENETRATING AND LUBRICATING COMPOSITION

BACKGROUND OF THE INVENTION

1. Field of the Invention

This invention relates generally to penetrating agents which are applied to seized, rusted, or corroded metal parts to free them by seeping into the minute cracks separating the parts and dissolving any corrosion present. More particularly, this invention relates to such a penetrating agent that has dissolved in it a siloxane polymer which is carried into the cracks and is left to coat the parts after the penetrant has volitalized. The siloxane polymer lubricates the parts and prevents further corrosion.

2. Prior Art

Penetrating agents are commonly used to free metal parts such as nuts, bolts, machine screws, shafts, and similar parts that have become corroded and are "frozen". Many of these penetrating agents, along with compounds intended strictly for lubrication, include a siloxane polymer or some other silicone ingredient to give the formula additional lubricating properties. U.S. Pat. Nos. 3,468,688 (Mitachek), 3,928,218 (Rowe), and 4,059,534 (Morro) all describe lubricating formulas composed of a silicone fluid and a hydrocarbon oil having a relatively high viscosity in order to give good lubricating properties.

Penetrating oils making use of silicone fluids are disclosed in U.S. Pat. Nos. 2,467,178 (Zimmer), and 3,578,596 (Conway). Zimmer calls for a silicone polymer, an aromatic hydrocarbon oil, and a surfactant ingredient such as tricresyl phosphate to reduce the surface tension of the composition and so enhance its penetrating ability. Conway likewise uses a hydrocarbon oil as a carrier for a silicone polymer and includes an alkyl ester of carboxylic acid which serves as a surfactant.

By using hydrocarbon oils as the carrier for the silicone ingredient, these known penetrating oils absolutely require a surfactant additive to lower the formula's surface tension so that it can effectively penetrate into corroded parts.

SUMMARY OF THE INVENTION

The formula of the present invention makes use of a glycol ether having an extremely low surface tension as a penetrant and as a carrier for a dimethyl siloxane polymer which gives the formula superior residual lubricating characteristics. The use of glycol ether as the carrier yields two main advantages: (1) No additional ingredients are needed to enhance the penetrating or lubricating qualities of the mixture as is the case in known penetrating oil compositions, and (2) No petroleum based chemicals are used in the formula, this being a feature of considerable benefit in view of current trends in petroleum price and availability.

In use, the composition is applied to the exterior of the corroded parts that are to be separated. The extremely low surface tension of the glycol ether solvent—on the order of from 25 to 30 dynes per centimeter at 25° centigrade—allows the formula to seek out and seep into the most minute cracks between the surfaces to be freed and dissolve any rust or corrosion present. The dimethyl siloxane polymer is carried into the cracks with the glycol ether in which it is dissolved and remains on the surfaces as a lubricating and corrosion preventing coating after the glycol ether has evaporated.

For the purposes of this invention, glycol ether will be defined as the ethers of ethylene, propylene, diethylene, or dipropylene glycol. These are produced by the reaction of alkylene oxides with alcohols or phenols, the glycol ethers used in the following examples were obtained from the Dow Chemical Company which markets them under the trade name Dowanol.

The dimethyl siloxane polymer used is of the general formula:

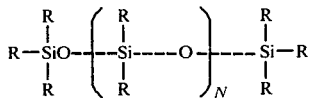

where R is a methyl group in essentially all cases and the value of N determines the viscosity of the polymer. That used in the following test was obtained from the Dow Corning Corporation and is marketed under the trade name Dow Corning 200 fluid.

The invention will be more clearly explained by referring to the following examples, which are illustrative rather than limiting.

EXAMPLE 1

One fluid ounce of Dow Corning 200 fluid of 100 centistokes viscosity (at 25° centigrade) was mixed with one gallon of Dowanol EB (ethylene glycol butyl ether). This formulation was found to have superior penetrating lubricating properties when applied to corroded metallic parts.

EXAMPLE 2

A mixture of one fluid ounce of Dow Corning 200 fluid of 100 centistokes viscosity and one gallon of Dowanol DE (diethylene glycol ethyl ether) was made and tested with good results.

EXAMPLE 3

A mixture of one fluid ounce of Dow Corning 200 fluid of 100 centistokes viscosity and one gallon of Dowanol PM (propylene glycol methyl ether) was made and tested with good results.

EXAMPLE 4

A mixture of one fluid ounce of Dow Corning 200 fluid of 100 centistokes viscosity and one gallon of Dowanol DPM (dipropylene glycol methyl ether) was made and tested with good results.

The above examples are listed in order of declining overall efficiency as penetrating and lubricating compositions as indicated by testing. The Dow Corning 200 fluid was selected with a viscosity of 100 centistokes on the basis of ease of blending with the Dowanol solvents. A wide range of viscosities may be used, however, without departing from the scope of this invention. Tests have been made with Dow Corning 200 fluid ranging from 50 to 150 centistokes viscosity with adequate results.

It has been found that the upper limit on the volume of dimethyl siloxane polymer that can be dissolved in one gallon of glycol ether is approximately 2 fluid ounces. Above this limit it is difficult to insure that the polymer will remain in solution. The lower limit, below which the mixture fails to exhibit adequate lubricating properties, is on the order of 1 fluid ounce per gallon of glycol ether. These functional limits will vary somewhat depending on the viscosity of the polymer used.

The above examples should not be construed as to limit the invention to the specific glycol ethers mentioned, as there are many other chemicals that fall under the category specified in the following claims.

The embodiments of the invention in which an exclusive property or privilege is claimed are defined as follows:

1. A penetrating and lubricating composition consisting essentially of:

(a) from 0.7% to 1.6% by volume of a dimethyl siloxane polymer; and (b) a glycol ether selected from the group consisting of ethers of ethylene glycol, ethers of propylene glycol, ethers of diethylene glycol, and ethers of dipropylene glycol.

2. The composition of claim 1 wherein said glycol ether is ethylene glycol butyl ether.

3. The composition of claim 1 wherein said dimethyl siloxane polymer has an average viscosity at 25° centigrade of about 100 centistokes.

4. A penetrating and lubricating composition consisting essentially of a mixture of:

(a) one gallon of ethylene glycol butyl ether; and (b) one fluid ounce of a dimethyl siloxane polymer having a viscosity of about 100 centistokes at 25° centigrade.

* * * * *